US005361572A

United States Patent [19]

Uematsu et al.

[11] Patent Number: 5,361,572

[45] Date of Patent: Nov. 8, 1994

[54] FLUFF CLEANING TRUCK

[75] Inventors: Ikuzo Uematsu; Tomoaki Takahashi, both of Kyoto, Japan

[73] Assignee: Murata Kikai Kabushiki Kaisha, Kyoto, Japan

[21] Appl. No.: 52,083

[22] Filed: Apr. 22, 1993

[30] Foreign Application Priority Data

Apr. 30, 1992 [JP] Japan ..... 4-137891

[51] Int. Cl.[5] ..... D01H 11/00; D01H 13/26

[52] U.S. Cl. ..... 57/304; 15/312.10; 19/263; 57/305; 57/306

[58] Field of Search ..... 15/312.1; 19/263, 264, 19/265; 28/295; 57/300, 303, 304, 305, 306

[56] References Cited

U.S. PATENT DOCUMENTS 4,133,168 1/1979 Keller et al. ..... 57/304
4,484,434 11/1984 Rummele ..... 57/304
4,662,167 5/1987 Stahlecker ..... 57/304 X

FOREIGN PATENT DOCUMENTS 0409457 1/1991 European Pat. Off. ..... 19/264
2804606 8/1979 Germany ..... 57/306
3929490 3/1991 Germany ..... 19/264

*Primary Examiner*—Daniel P. Stodola
*Assistant Examiner*—William Stryjewski
*Attorney, Agent, or Firm*—Spensley Horn Jubas & Lubitz

[57] ABSTRACT

A fluff cleaning truck moves along the textile machine being operated to efficiently and automatically remove fluff. The cleaning truck is loaded with cleaning members and travels along the frame of a textile machine and stops at a desired position to clean at all once desired portions of the textile machine being operated by unit of plural spindles.

3 Claims, 5 Drawing Sheets

FLUFF CLEANING TRUCK

BACKGROUND OF THE INVENTION

1. Field of the Invention

This invention relates to a fluff cleaning truck which travels along the frame of a textile machine such as a spinning machine to remove fluffs adhered to and accumulated on various portions.

2. Prior Art

In the textile machine, especially in the step of producing spinning yarns, an extremely large amount of fluffs or fly wastes occur. These fluffs adversely affect on the environment and lowers the function caused by adhesion thereof to the machine. In addition, the products are adversely affected by irregular take-in of fluffs. In the spinning apparatus, air is always brown against essential portions to prevent adhesion of fluffs. This process merely move the fluff to other parts, and the adhesion of the fluff to draft parts, spindle bearings and so on still poses a significant problem. In the past, for removing the fluff, an operator goes round the machine periodically or unperiodically to clean them by hand or the textile machine itself is overhauled once a month to remove a large amount of fluff.

Some of large spinning machines have 1000 spindles on both surfaces. The cleaning and overhaul by the operator as mentioned above are very troublesome, and it is difficult to satisfactorily remove the fluff by the cleaning conducted by the operator.

SUMMARY OF THE INVENTION

An object of this invention is to provide a fluff cleaning truck which can efficiently and automatically remove fluff by traveling along a textile machine during operation.

For achieving the object, this invention provides a fluff cleaning truck which is loaded with cleaning members, travels along the frame of a textile machine, and stops at a desired position to clean all at once desired places of the textile machine during operation by plural spindles.

In the fluff cleaning truck constructed as described above, when the textile machine is operated, the truck stops at a desired position of the textile machine to clean all at once desired places in a plurality of spindles thereof.

DETAILED DESCRIPTION OF PREFERRED EMBODIMENT

An example in which a fluff cleaning truck of this invention is applied to a spinning machine will be described with reference to FIGS. 1 to 6.

Figure 6:
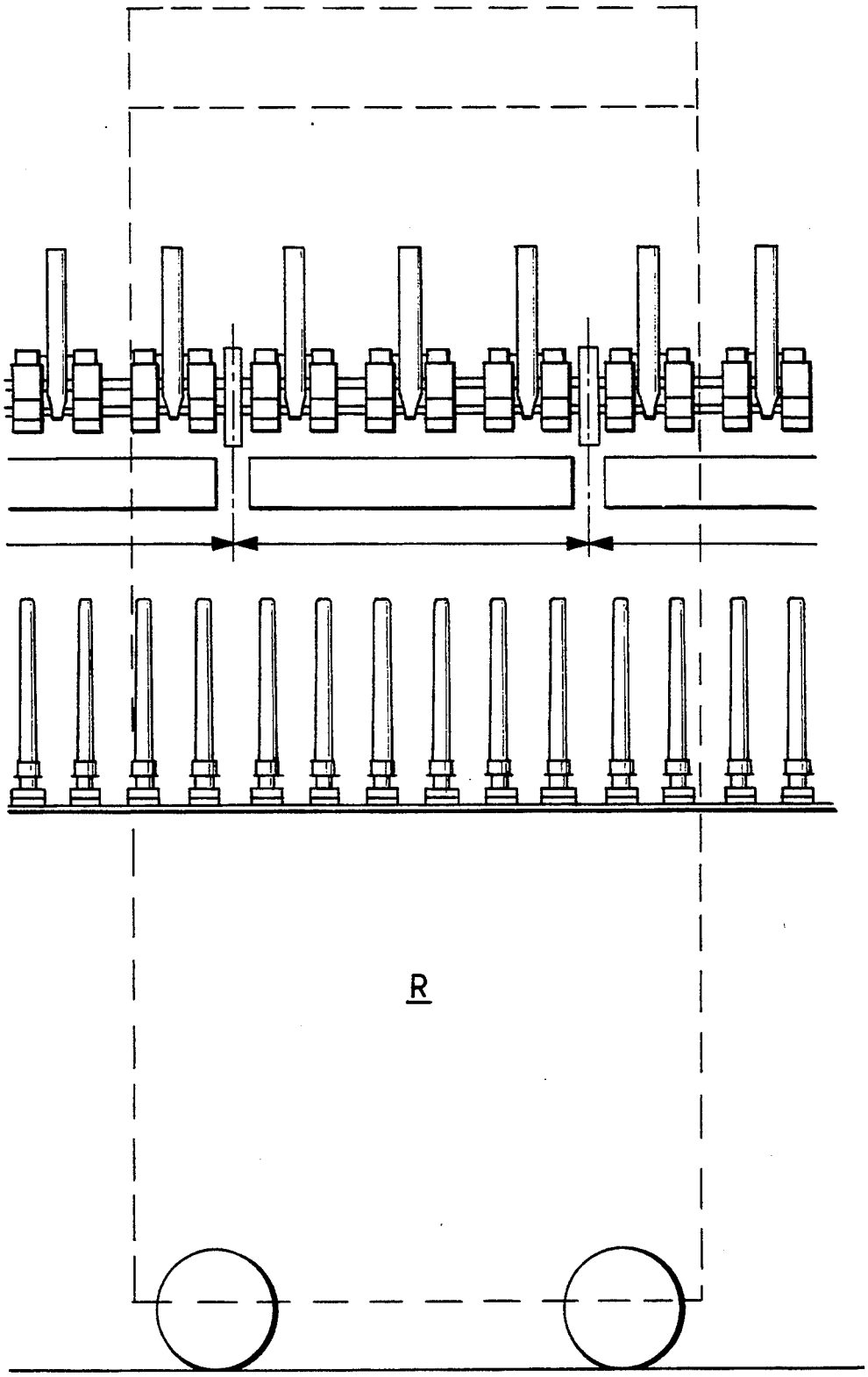
FIG. 6 is a front view explaining an arrangement of the cleaning trucks for cleaning by unit frames.

This cleaning truck R travels along the frame of a spinning machine S being operated and comprises a stripping rod 1 for mainly cleaning a fixed shaft, a suction pipe 2 for cleaning a rotary shaft or sucking fluff adhered to other members, a low pressure air jet pipe 3 for blowing off fluff accumulated on portions other than a fixed shaft and a rotary shaft, and so on. The truck R stops by a unit frame comprised of six spindles as shown in FIG. 6, for example, to perform cleaning. These cleaning means are supported on the truck to be moved forward and backward so that they except some do not touch members of the spinning machine S or yarns or the like when the truck travels, and advance toward the spinning machine when stops every unit frame.

The cleaning truck R detects pins provided corresponding to each unit frame of the frame of the spinning machine S to perform positioning at the time of stop. Further, the cleaning truck R is provided with roll wheels 4 or the like so that the former can be moved easily in an attempt of being set to a suitable spinning machine S for operation without belonging exclusively to each spinning machine S.

The stripping rod 1 has an end 1*a* made of nylon with a taper at the end of a rod having about 4 mm of diameter, and fine rugged portions are formed on the surface thereof so as to easily strip the fibers. The end portion is made of nylon because of the fact that even if the end portion should contact a shaft or a rubber roller which rotates at high speeds, they would not be damaged.

When the cleaning truck R stops every unit frame to remove fluff wound on a fixed shaft, the stripping rod 1 first moves to a position slightly away from the peripheral surface of one end of the fixed shaft while rotating about 200 times per minute. Then, the cleaning truck R advances and moves till the periphery surface of the end 1*a* of the stripping rod comes into contact with the fixed shaft. Then, the cleaning truck R moves forward and backward while moving toward the other end of the fixed shaft with the peripheral surface of the end remained in contact with the fixed shaft to remove the fluff wound on the fixed shaft. By causing the stripping rod to be moved as described, the fluff over the full length of the fixed shaft is removed. The fluff adhered to the back of the fixed shaft cannot be completely removed by the mere suction by the suction pipe.

Members to be cleaned by the stripping rod 1 first include fixed shafts 5, 6 and 7 for supporting top rollers projected from pendulum arms for supporting top rollers of a draft part. The same is true for other fixed shafts. But, even fluff wound on the rotating portion but not rotated along with the rotating portion is to be cleaned by the stripping rod 1. Even frame parts other than the draft part, for example, a spindle bearing portion 8 or the like which is in contact with the rotary shaft but the fluff is not rotated may be cleaned by the stripping rod 1.

Figure 1:
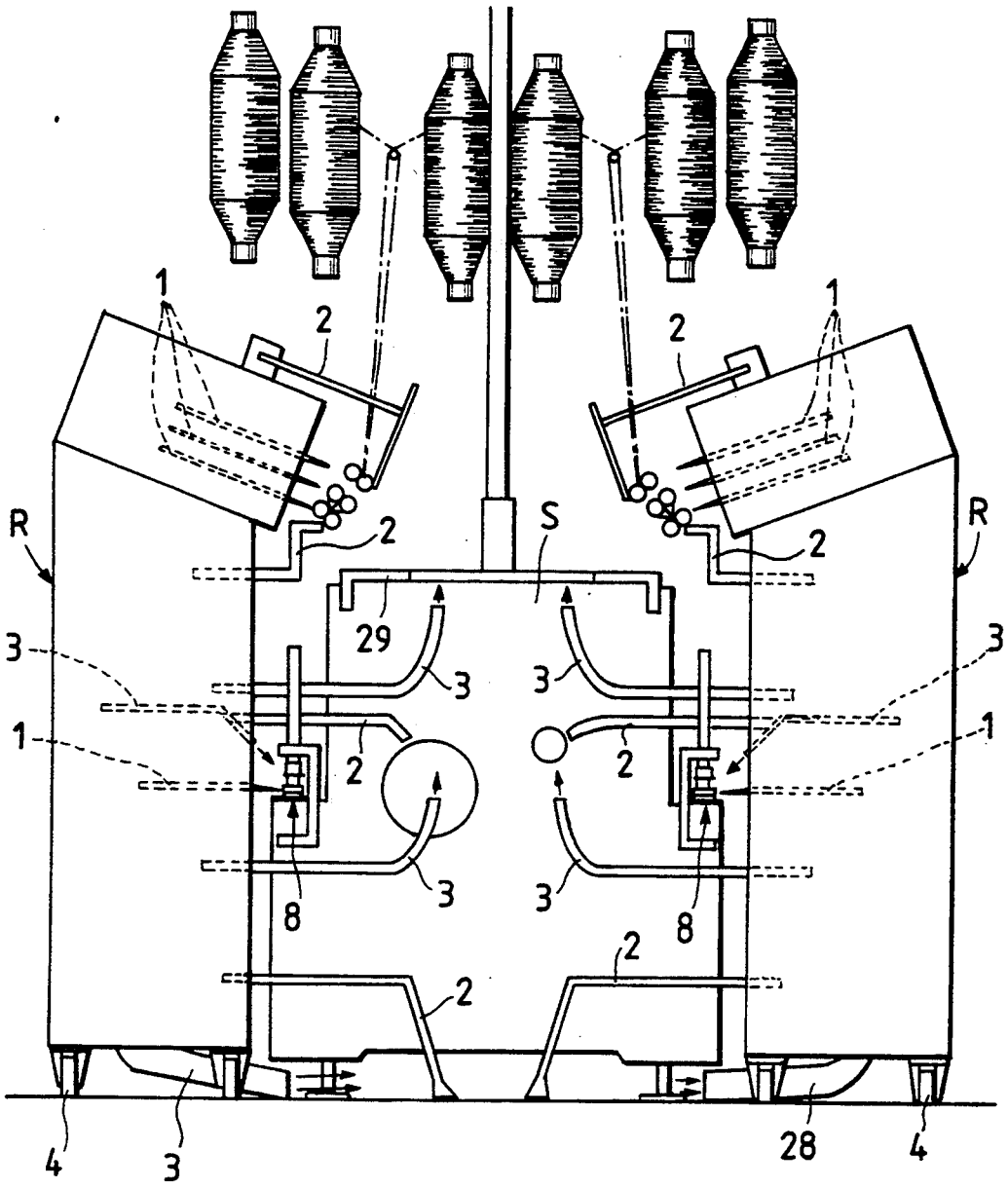
FIG. 1 is a side view when a fluff cleaning truck is applied to a spinning machine.
Figure 2:
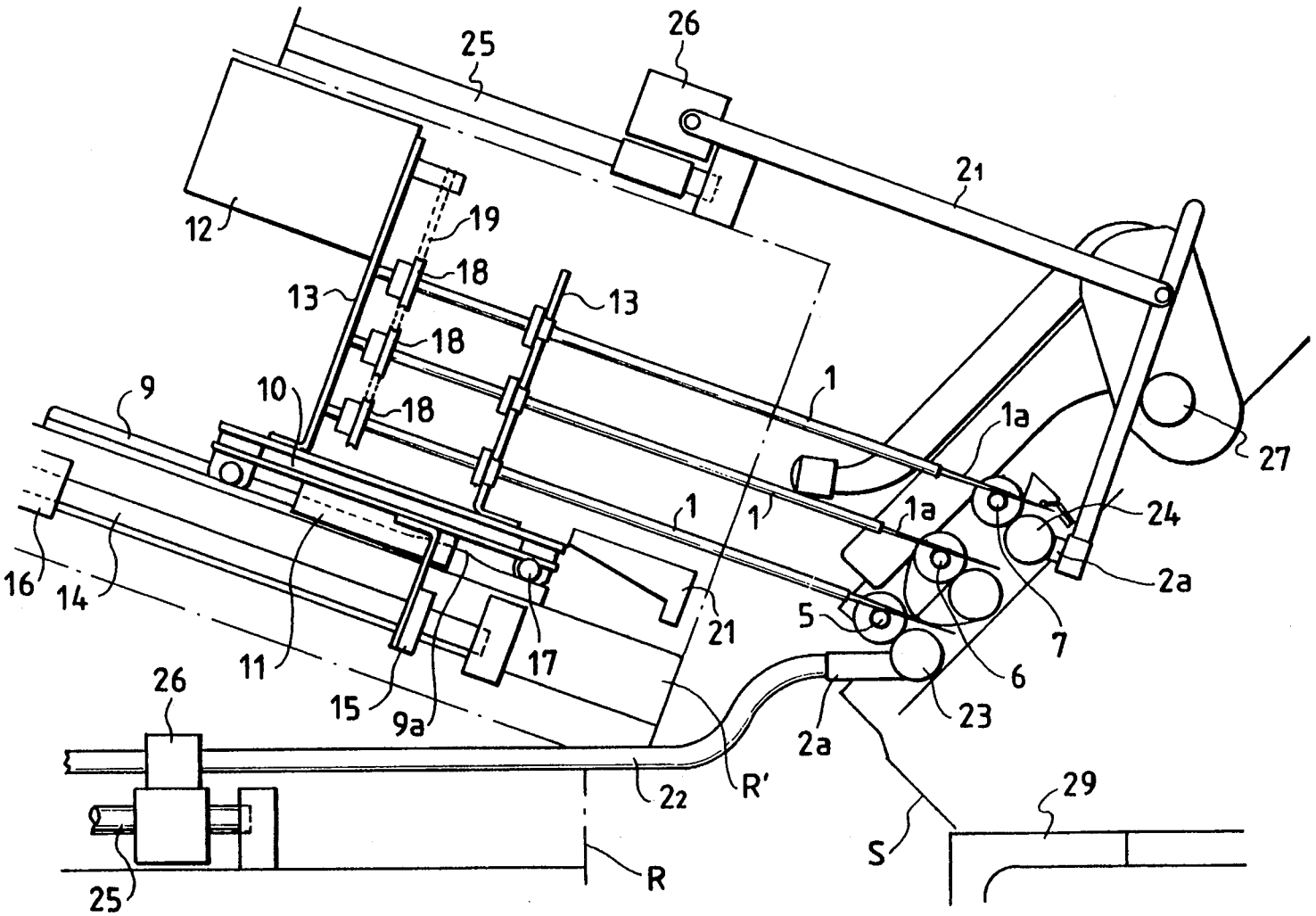
FIG. 2 is a side view when a stripping rod and a suction pipe are applied to cleaning of a draft part.

An example will be described with reference to FIG. 2, in which the stripping rod 1 is applied to cleaning of the top roller supporting fixed shafts 5, 6 and 7 of the draft part.

Above the cleaning truck R is provided a movable portion R′ which is moved by a suitable mechanism in a direction along the frame of the spinning machine S when the stripping rod 1 performs a cleaning operation. A guide rail 9 is provided in a direction perpendicularly intersecting the frame of the spinning machine S, and a stripping rod setting base 10 is arranged to be moved forward and backward along the guide rail 9. A guide block 11 for guiding so as not to be disengaged from the guide rail 9 is hung besides the stripping rod setting base 10, and upwardly thereof, there is provided a frame 13 for supporting the stripping rod 1 and a small-sized motor 12 for rotating the stripping rod 1. This frame 13 is provided with sets of stripping rods 1 each set comprising three (18 in total) corresponding to spindles belonging to the unit frame 13. Further, below the stripping rod setting base 10 is provided a member 15 in engagement with a bowl screw 14 driven and rotated by a motor 16 so that the stripping rod setting base 10 can be moved forward and backward with respect to the spinning machine S by the rotation of the bowl screw 14. A portion 9*a* raised from the periphery is formed at a position near the spinning machine S of the guide rail 9, and when a front wheel 17 of the stripping rod setting base 10 moves beyond the portion 9*a*, the stripping rod 1 advances upwardly slightly away from the peripheral surfaces of the fixed shafts 5, 6 and 7 and after this the stripping rod 1 further advances closer till the peripheral surface of the end portion 1*a* comes in contact with the fixed shafts 5, 6 and 7. Each of the stripping rods 1 is rotated by the power transmitted from the motor 12 through a belt 19 passed over between a pulley 18 and the motor 12 secured thereto. After the stripping rod 1 advances into contact with the fixed shafts 5, 6 and 7, the movable portion R' is moved along the frame of the spinning machine S by means of a cam or the like not shown. During that period, the stripping rod setting base 10 repeatedly moves forward and backward to strip the fluffs wound on the fixed shafts 5, 6 and 7.

Figure 4:
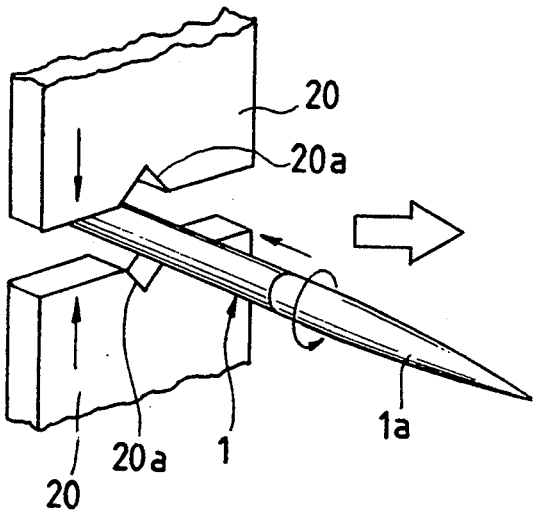
FIG. 4 is a perspective view before and after the removal of fluff in a fluff removing device.
Figure 4:
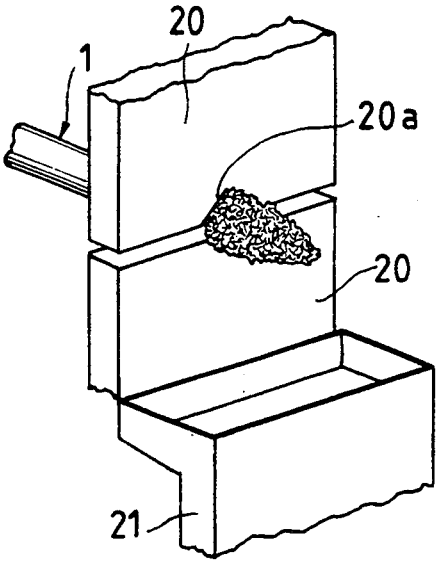

The removal of the fluff wound on the stripping rod 1 is carried out by putting the end portion 1*a* of the stripping rod between two scrape blocks 20 formed of hard urethane rubber having a V-shaped depression 20*a* in the middle between the opposed ends, as shown in FIG. 4, and drawing the same. That is, the distance of the circumference of a hole surrounded by the V-shaped depressions 20*a* of the two scrape blocks 20 ends of which are abutted is set to be smaller than an outside diameter of the stripping rod 1, the stripping rod 1 being disposed so that the center thereof is positioned at a center position of the hole formed by the V-shaped depression 20*a*. When the wound fluff is removed, the scrape blocks 20 are moved close to each other to put the stripping rod 1 therebetween, and in that state, they are moved backward while stopping or rotating the stripping rod 1. With this, since the end portion 1*a* of the stripping rod 1 is in the form of a taper, the fluff can be easily moved to a smaller diameter position and can be simply taken off. The taken-off fluff is discharged by a sucker 21 disposed at a lower portion.

Figure 3:
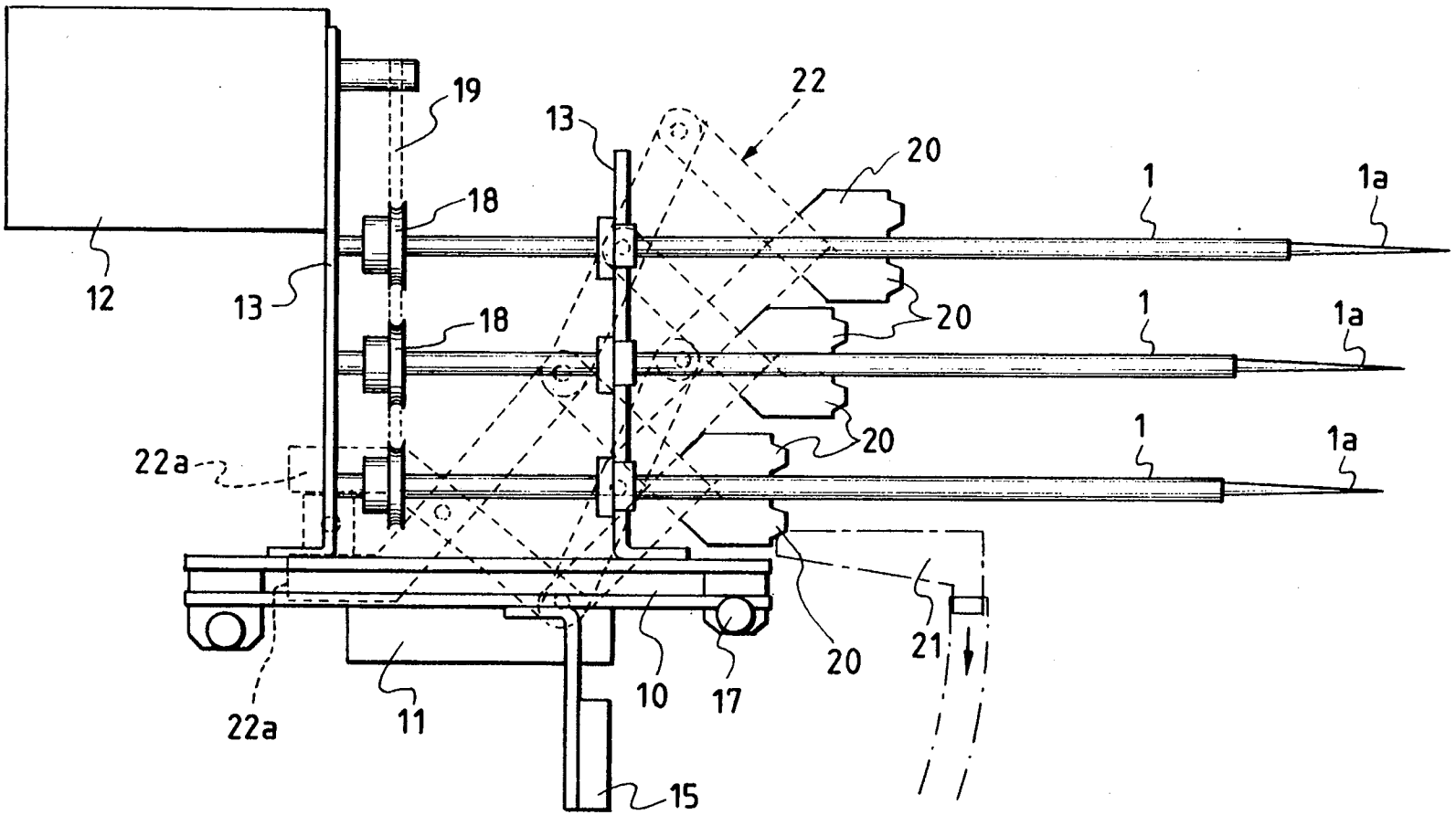
FIG. 3 is a side view when a fluff removing device is applied to cleaning of a draft part.

An example will be described with reference to FIG. 3, in which a fluff removing device comprised of the scrape blocks 20 and the sucker 21 is applied to the cleaning of the draft part.

The scrape blocks 20 are supported on the stripping rod setting base 10 by a link mechanism 22 shown by the dotted lines vertically with the stripping rod 1 sandwiched therebetween. Between two levers 22*a* biased in a direction close to each other on the base of the link mechanism 22 is provided a cam (not shown) which is supported on the stripping rod setting base 10 and rotated by a rotary solenoid or the like. The scrape blocks 20 are moved to and away simultaneously through the link mechanism by the rotation of the cam. The movement of the scrape blocks 20 to and from is synchronized with the backward movement of the stripping rod 1 as previously mentioned.

The suction pipe 2 is made of copper or steel. The suction pipe 2 is strong in suction force if it is brought into direct contact with the rotary shaft on which the fluff is wound. However, the suction pipe 2 is placed in contact with the rotary shaft through a base 2*a* made of nylon or Derlin in order not to damage the rotary shaft.

When the cleaning truck R stops every unit frame to remove the fluff which is wound on the rotary shaft and rotates therewith, the suction pipe 2 has its base 2*a* moved close to the peripheral side of the rotary shaft by a suitable mechanism.

Members cleaned by the suction pipe 2 first include driving shafts for front bottom rollers 23 and back bottom rollers 24 of the draft part. The bottom roller formed with a number of lateral grooves is formed on both ends thereof with rings called fiber rings to which fluff is adhered. When the fiber ring grows, it is arrested by the fiber bundle which advances while traversing, which leads to a defective yarn. In the past, this fiber ring has been scraped off with a brush or a sickle by the operator during the operation. The suction pipe 2 is mainly used to scrape off the fiber ring. Even frame parts other than the draft part, which rotate along with the rotary shaft, for example, tension pulleys or the like for driving spindles, are cleaned by the suction pipe 2.

An example will be described with reference to FIG. 2, in which the suction pipe 2 is applied to the cleaning of the back and front rollers 23, 24 of the draft part.

The suction pipe 2 is provided movably forward and backward with respect to the cleaning truck R. That is, the suction pipe 2 is provided with a member 26 in engagement with the bowl screw 25 driven and rotated by a motor not shown. The suction pipe 2 can be moved forward and backward with respect to the spinning machine S by the rotation of the bowl screw 25. A suction pipe $2_1$ for cleaning the bottom back roller 24 is folded into two sections for the sake of move-in course, and the end portion thereof is urged counterclockwise by a torsion spring housed in the folded portion. When the suction pipe 2 advances, the end portion thereof impinges upon a projection 27 on the side of the spinning machine S and rotates clockwise against the force of the torsion spring. As a result, the base 2*a* thereof comes into contact with the bottom front roller 24. A suction pipe $2_2$ for cleaning the bottom top roller 23 merely moves forward and backward.

The fluff adhered to or accumulated on the frame parts other than the draft part, which cannot be processed either by the stripping by means of the stripping rod 1 or by the suction by means of the pipe 2 is brown off by jetting a low pressure air from the air jet pipe 3. Thus thus fallen fluff is sucked and discharged by a suction pipe 28 having a large opening or recovered by making use of the stripping rod 1 and the suction pipe 2. The fluff above a deck 29 of the draft part is brown off onto the deck 29, and that below the deck 29 of the draft part is brown off under the deck 29.

In the textile machine having winding portions on both sides of the frame as in the spinning machine S, two cleaning trucks different in function from each other are prepared to facilitate the recovery of fluff making use of the low pressure air jet, and are arranged face to each side of the respective frames and simultaneously travelled. For example, the low pressure air jet pipe 3 is loaded on one cleaning truck, and the suction pipe 28 having a large opening is loaded on the other cleaning truck to share a role. In this way, the efficiency of fluff recovery can be enhanced.

Figure 5:
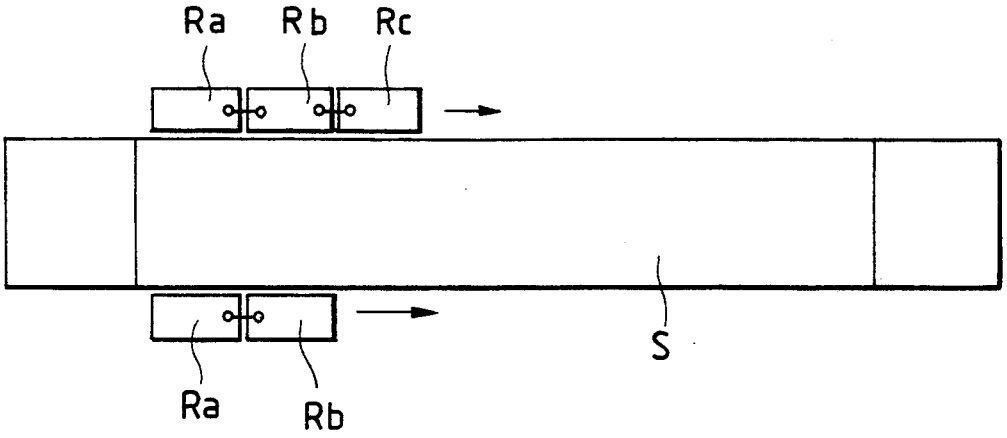
FIG. 5 is a plan view showing the relationship between the spinning machine and cleaning trucks different in works from each other.

All the portions to be cleaned which have been described may be cleaned by a single cleaning truck with all cleaning means loaded thereon. Also, as shown in FIG. 5, works of the stripping by the stripping rod 1, the suction by the suction pipe 2 and the blowing-off by the low pressure air jet pipe 3 are divided, and exclusive-use trucks Ra, Rb and Rc respectively loaded with one kind of cleaning means are provided so that the trucks can be travelled in the state where they are connected or can be travelled individually. In this manner, all the cleaning trucks need not be travelled every time but some cleaning trucks may be travelled once per several times thus saving the energy.

With the construction as described above, the present invention exhibits the following effects.

That is, the fluff generated from the textile machine can be efficiently and automatically removed without stopping the operation of the textile machine. Accordingly, a burden of an operator can be considerably relieved.

What is claimed is:

1. A fluff cleaning truck for traveling along a frame of a textile machine and cleaning the textile machine during operation, the textile machine having at least one fixed shaft, the truck comprising:

a suction pipe for vacuuming fluff adhering to the textile machine, an air jet pipe for blowing off fluff accumulated on the textile machine, and stripping means for cleaning the fixed shaft, the stripping means comprising:

a stripping rod comprising a tapered end, means for rotating the stripping rod, means for establishing contact between the end of the stripping rod and the fixed shaft, means for moving the stripping rod relative to the fixed shaft while maintaining contact between the end of the stripping rod and the fixed shaft, and at least one scraper for removing fluff adhering to the stripping rod.

2. The fluff cleaning truck of claim 1, wherein the stripping rod has an exterior defining a first diameter, wherein the scraper has an aperture defining a second diameter, and wherein the first diameter is greater than the second diameter.

3. A fluff cleaning truck for traveling along a frame of a textile machine and cleaning the textile machine during operation, the textile machine having at least one fixed shaft, the truck comprising:

a stripping rod comprising a tapered end, means for rotating the stripping rod, means for establishing contact between the end of the stripping rod and the fixed shaft, means for moving the stripping rod relative to the fixed shaft while maintaining contact between the end of the stripping rod and the fixed shaft, and at least one scraper for removing fluff adhering to the stripping rod.

* * * * *